United States Patent [19]

Smith et al.

[11] 4,395,616

[45] Jul. 26, 1983

[54] CONTINUOUS-WAVE PLASMA-ASSISTED RADIATION TREATMENT OF REFLECTIVE SOLIDS

[75] Inventors: David C. Smith; Russell G. Meyerand, Jr., both of Glastonbury, Conn.

[73] Assignee: United Technologies Corporation, Hartford CT

[21] Appl. No.: 217,475

[22] Filed: Dec. 17, 1980

[51] Int. Cl.[3] ..... B23K 27/00

[52] U.S. Cl. ..... 219/121 L; 219/121 LQ; 219/121 LS

[58] Field of Search ..... 219/121 L, 121 LM, 121 LS, 219/121 FS, 121 LP, 121 LY, 121 LE, 121 LF, 121 LK, 121 LL, 121 LC, 121 LD, 121 LQ, 121 LR; 250/423 P, 306

[56] References Cited

U.S. PATENT DOCUMENTS

| | | | |
|---|---|---|---|
| 3,588,440 | 6/1971 | Morse | 219/121 LF |
| 3,775,638 | 11/1973 | Tidman | 219/121 L |
| 3,824,368 | 7/1974 | Locke | 219/121 LD |
| 4,078,167 | 3/1978 | Banas et al. | 219/121 FS |
| 4,127,761 | 11/1978 | Pauley et al. | 219/121 FS |
| 4,220,842 | 9/1980 | Sturmer | 219/121 FS |

*Primary Examiner*—C. L. Albritton

*Attorney, Agent, or Firm*—Eric W. Petraske

[57] ABSTRACT

Coupling of a CW laser beam to a reflective surface is enhanced by a plasma that is confined to the surface region by a transverse gaseous flow.

3 Claims, 2 Drawing Figures

CONTINUOUS-WAVE PLASMA-ASSISTED RADIATION TREATMENT OF REFLECTIVE SOLIDS

DESCRIPTION

Technical Field

The technical field of the invention is the use of a laser for treating a reflective solid surface, either heat-treating a workpiece or in a laser weapon for moving targets.

Background Art

The article "Plasma Energy Transfer to Metal Surfaces Irradiated by Pulsed Lasers", by A. N. Pirri et al, teaches that coupling of radiation to a metal surface may be enhanced by igniting a plasma close to the surface and then maintaining the plasma for a certain optimum time, determined by the beam spot radius divided by the speed of sound in the plasma. U.S. Pat. No. 3,588,440, issued to James H. Morse on June 28, 1971, discloses the use of two lasers to treat a workpiece; a pulsed laser being used to form a puddle of molten metal and a second continuous-wave laser is used to maintain the metal in a molten state.

Disclosure of Invention

According to the invention, the coupling between an incident continuous-wave laser and a reflective surface is enhanced by the interaction of the CW laser beam and the plasma, the plasma being ignited by a higher intensity pulsed laser beam. The plasma is prevented from travelling up the laser beam by transverse motion of gas across the laser beam, since separation of the plasma from contact with the surface results in reduced laser energy coupling into the surface.

BEST MODE FOR CARRYING OUT THE INVENTION

Figure 1:
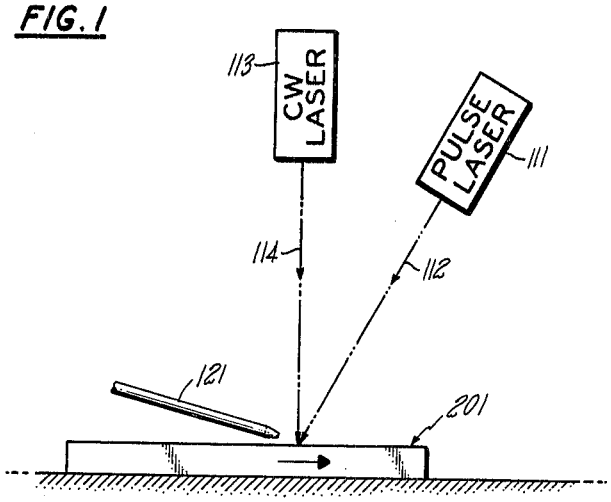
FIG. 1 illustrates an embodiment of the invention for heat-treating a workpiece.

In FIG. 1, pulsed laser 111 directs beam 112 onto workpiece 201 at a predetermined position. The beam intensity required to ignite a plasma is known to those skilled in the art and may be given by the formula:

$$I_i = 7.5/\lambda(t)^{\frac{1}{2}} \text{ Watts/cm}^2$$

where $I_i$ is the ignition itensity, $\lambda$ is the laser beam wavelength and t is the length of an ignition pulse. For a 10 $\mu$m wavelength radiation beam, pulsed for 10 $\mu$sec, the ignition intensity required will be $\sim 2\times 10^6$ W/cm$^2$. In the above calculation of the ignition threshold, it is assumed that the surface has defects or inclusions that are $\sim$100 microns in size which are the localized sites of ignition. For surfaces which have even smaller inclusions the ignition threshold scales as $r^{-\frac{1}{2}}$ where r is the inclusion size. The foregoing formula is presented in "Gas Breakdown Initiated by Laser Radiation Interaction With Aerosols and Solid Surfaces", D. C. Smith, Journal of Applied Physics, Vol. 48, p. 2217, June 1977, incorporated herein by reference.

Once ignited, the plasma is maintained by continuous-wave laser 113, which directs beam 114 onto the same spot on workpiece 201 as that struck by beam 112. For purposes of heat-treating, the maintenance intensity will be close to the minimum value in order to avoid damage to workpiece 201. The minimum maintenance intensity for a 10.6 $\mu$m beam in air may be given by:

$$I_m = \frac{2.6\times 10^3}{D^2} + 1\times 10^4 \text{ Watts/cm}^2$$

where $I_m$ is the maintenance intensity and D is the beam spot diameter in centimeters. The foregoing theoretical formula is given in "Ignition and Maintenance of Subsonic Plasma Waves in Atmospheric Pressure Air by $CO_2$ Laser Radiation and Their Effect on Laser Beam Propagation", M. C. Fowler and D. C. Smith in Journal of Applied Physics, Vol. 46, p. 138, January 1975, incorporated herein by reference. The laser beam spot will be moved over the surface of workpiece 201 by conventional means of moving the workpiece and/or moving the beam spot, such methods being well known to those skilled in the art. In order to prevent the plasma from propagating up beam 114 and thus reducing the coupling to workpiece 201, it has been found that a transverse gas flow, or "wind" will confine the plasma to the surface of workpiece 201. The minimum wind velocity, V, is given by V=ID/34 cm/sec, where I is the intensity of beam 114 in W/cm$^2$ and D is the beam diameter in centimeters. In the case of a 1. cm diameter beam, the maintenance intensity is $10^4$ W/cm$^2$ and the wind velocity for plasma confinement is approximately 300 cm/sec.

Figure 2:
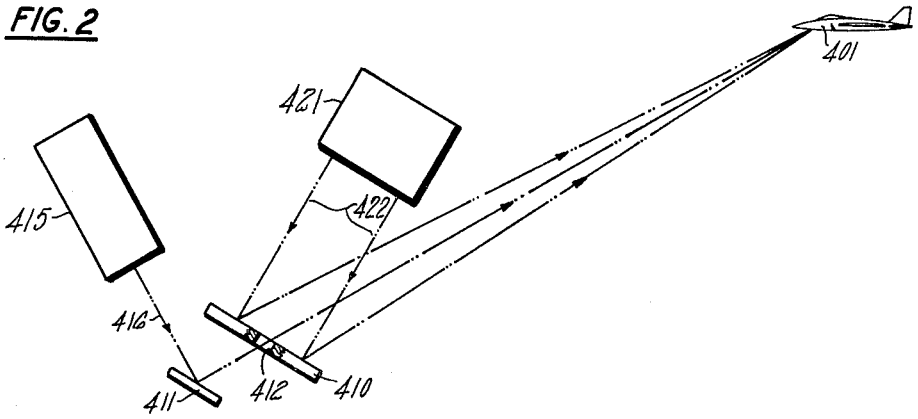
FIG. 2 illustrates an embodiment of the invention for a laser weapon.

In FIG. 2, an embodiment of the invention for a laser weapon is illustrated, in which target 401 is illuminated by a pulsed ignition beam 416 from pulsed laser 415 and a CW main beam 422 from CW laser 421. Illustratively, beam 422 has an annular cross section and is directed at target 401 by controllable annular mirror 410 having a hole 412 in its center. Ignition beam 416 is illustratively directed by mirror 411 through hole 412 and travels collinearly with beam 422 to target 401. Mirrors 411 and 410 are controlled by conventional tracking means not shown to maintain the laser beam on moving target 401. The motion of target 401 supplies the necessary cross wind for plasma confinement. A target of 2024 Aluminum, 0.064 in. thick was penetrated with and without plasma enhancement, using a twelve kilowatt $CO_2$ laser, focussed to a 0.5 cm diameter beam spot. Without a plasma at the target, penetration time averaged 5.2 seconds; with plasma coupling, the average penetration time was 0.68 seconds.

Other means of combining the ignition and maintenance beams will be apparent to those skilled in the art, such as using a single variable-intensity laser for both ignition and maintenance and repetitively igniting a plasma to compensate for possible tracking error.

We claim:

1. An apparatus for irradiating a moving target having a surface exposed to the atmosphere comprising:

guiding means for tracking said target and for directing optical radiation through the atmosphere at said target along a nonconductive optical path;

laser means, transmitting laser radiation through said guiding means, for igniting a plasma adjacent a portion of said surface, said laser means further comprising a continuous-wave laser for maintaining said plasma, said plasma being confined adjacent said surface by the motion of said target relative to the atmosphere which motion maintains said nonconductive optical path in a nonconductive state.

2. An apparatus according to claim 1, in which said laser means further comprises a pulsed laser for igniting said plasma and said guiding means further comprises means for combining radiation from said pulsed laser and said continuous-wave laser.

3. An apparatus for irradiating a workpiece comprising:

a pulsed laser for generating a pulsed laser beam;

a continuous-wave laser for generating a continuous-wave beam; and means for combining and focusing said beams to a common spot on said workpiece, characterized in that:

said apparatus further includes plasma confinement means for flowing a stream of gas through said beams and adjacent said common spot; and said pulsed laser is operated to ignite a plasma adjacent said common spot, said continuous-wave laser is operated to maintain said plasma and said plasma is confined adjacent said workpiece by said gaseous stream flowing from said plasma confinement means with a predetermined velocity across said beams, which predetermined velocity is greater than the quantity ID/40, where I is the intensity of said continuous-wave beam and D is the diameter of said continuous-wave beam across which said gaseous stream flows.

* * * * *